US006392599B1

(12) United States Patent
Ganeshmoorthy et al.

(10) Patent No.: US 6,392,599 B1
(45) Date of Patent: May 21, 2002

(54) COMMUNICATION ANTENNA AND EQUIPMENT

(75) Inventors: David Ganeshmoorthy; Kandiah Ganeshmoorthy; Richard Ganeshmoorthy, all of 2 Queens Court, 25 Earls Court Square, London SW5 9BA (GB)

(73) Assignees: David Ganeshmoorthy; Kandiah Ganeshmoorthy; Richard Ganeshmoorthy, all of London (GB)

( * ) Notice: Subject to any disclaimer, the term of this patent is extended or adjusted under 35 U.S.C. 154(b) by 0 days.

(21) Appl. No.: 09/381,390

(22) PCT Filed: Mar. 20, 1998

(86) PCT No.: PCT/GB98/00680

§ 371 Date: Sep. 20, 1999

§ 102(e) Date: Sep. 20, 1999

(87) PCT Pub. No.: WO98/43313

PCT Pub. Date: Oct. 1, 1998

(30) Foreign Application Priority Data

Mar. 20, 1997 (GB) ..... 9705777

(51) Int. Cl.[7] ..... H01Q 1/38

(52) U.S. Cl. ..... 343/700 MS; 343/702; 343/833; 343/834; 343/895

(58) Field of Search ..... 343/700 MS, 702, 343/895, 749, 750, 752, 833, 834

(56) References Cited

U.S. PATENT DOCUMENTS

| | | | | |
|---|---|---|---|---|
| 4,101,898 A | | 7/1978 | Ingram | 343/752 |
| 5,668,559 A | * | 9/1997 | Baro | 343/702 |
| 5,936,587 A | * | 8/1999 | Gudilev et al. | 343/752 |

FOREIGN PATENT DOCUMENTS

| | | | |
|---|---|---|---|
| EP | 0528775 | 2/1993 | H01Q/1/36 |
| EP | 0635898 | 1/1995 | H01Q/1/27 |
| EP | 0649181 | 4/1995 | H01Q/1/36 |

OTHER PUBLICATIONS

Patent Abstracts of Japan; vol. 018, No. 447 (E–1594), Aug. 19, 1994 & JP 06 140820 A (Sansei Denki KK), 20, see abstract.

Morgan M A Et Al: "Eigenmode Analysis of Dielectric Loaded Top–Hat Monopole Antennas" IEEE Transactions on Antennas and Propagation, vol. 42, No. 1, Jan. 1994, pp. 54–61, CP000434716 The whole document (To follow).

(List continued on next page.)

*Primary Examiner*—Don Wong
*Assistant Examiner*—Hoang Nguyen
(74) *Attorney, Agent, or Firm*—Davis & Bujold, P.L.L.C.

(57) ABSTRACT

A communication antenna (10) having a driven element (16) extending between a feed point (13) and an attachment point (15) to a top loaded element in which the driven element (16) is longer than the shortest distance (P) between the feed point (13) and the attachment point (15), the driven element (16) being configured to follow a meandering path between the feed point (13) and the attachment point (15). The driven element (16) is at least in part in the form of straight sections joined to give a zigzag configuration (16). Alternatively the driven element (16) is at least in part in the form of curved sections. At least a pair of parasitic elements (18, 19) can be provided with the members of the pair (18, 19) being disposed on opposite sides of, and off-set from, the driven element (16) and parallel to a straight ling (P) linking the feed point (13) to the attachment point (15); the parasitic elements (18, 19) serving to provide impedance matching and increased bandwidth and providing shielding against radiation from the antenna in a predetermined direction. Typically passive elements can be incorporated with the parasitic elements (18, 19) to provide for the overall reduction in the size of the antenna (10.

5 Claims, 1 Drawing Sheet

OTHER PUBLICATIONS

Koichi Ogawa et al.: "A Diversity Antenna For Very Small 700–MHZ Band Portable Telephones" IEEE Transactions on Antennas and Propagation, vol. 42, No. 9, Sep. 1994, pp. 1342–1345, XP0004660904 See whole document.

Nakano H. et al: "Shortening Ratios of Modified Dipole Antennas" IEEE Transactions on Antennas and Propagation vol. 32, No. 4, Apr. 1, 1984, pp. 385/386 XP002011484, the whole document.

* cited by examiner

COMMUNICATION ANTENNA AND EQUIPMENT

TECHNICAL FIELD

This invention relates to a communication antenna and in particular it is concerned with a communication antenna for a mobile phone.

BACKGROUND ART

Known antenna for a mobile phone consist of a helix with or without a radiating straight element. The helix serves to provide for radial radiation/reception. However some energy is lost as circular polarised radiation along the axis of the 'helicoil' section.

DISCLOSURE OF INVENTION

According to a first aspect of the present invention there is provided a communication antenna having a driven element extending between a feed point and an attachment point to a top loaded element characterised in that the driven element is longer than the distance between the feed point and the attachment point.

According to a first preferred version of the first aspect of the present invention the driven element is configured to follow a meandering path between the feed point and the attachment point.

According to a second preferred version of the first aspect of the present invention or the first preferred version thereof the driven element is at least in part in the form of straight sections joined to give a zigzag configuration.

According to a third preferred version of the first aspect present invention or the first preferred version thereof the driven element is at least in part in the form of curved sections.

According to a fourth preferred version of the first aspect of the present invention or any preceding preferred version thereof the driven element is of a predetermined length relating to operating frequency band and return loss requirements.

According to a fifth preferred version of the first aspect of the present invention or any preceding preferred version thereof the antenna is equipped with at least a pair of parasitic elements the members of the pair being disposed on either side or on opposite sides of, and off-set from, the driven element and parallel or slant to a straight line linking the feed point to the attachment point; the parasitic elements serving to provide impedance matching and increased bandwidth and providing shielding against radiation from the antenna in a predetermined direction. Typically passive elements are incorporated parasitic elements to provide for an overall reduction in the size of the antenna.

According to a second aspect of the present invention there is provided a mobile phone incorporating an antenna according to the first aspect or any preferred version thereof.

According to a first preferred version of the second aspect of the present invention the antenna is formed as a printed circuit board or is deposited on a laminar member having a structural function for at least a part of the phone.

According to a second preferred version of the second aspect of the present invention or the first preferred version thereof the parasitic elements are disposed relative to the driven element to provide increased bandwidth and shielding against radiation from the antenna in a predetermined direction such as towards a user of the phone or at least towards the nearest part of a user of the phone.

BRIEF DESCRIPTION OF DRAWINGS

An exemplary embodiment of the invention will now be described with reference to the accompanying diagrammatic drawings of an antenna of which.

MODE FOR CARRYING OUT THE INVENTION

Figure 1:
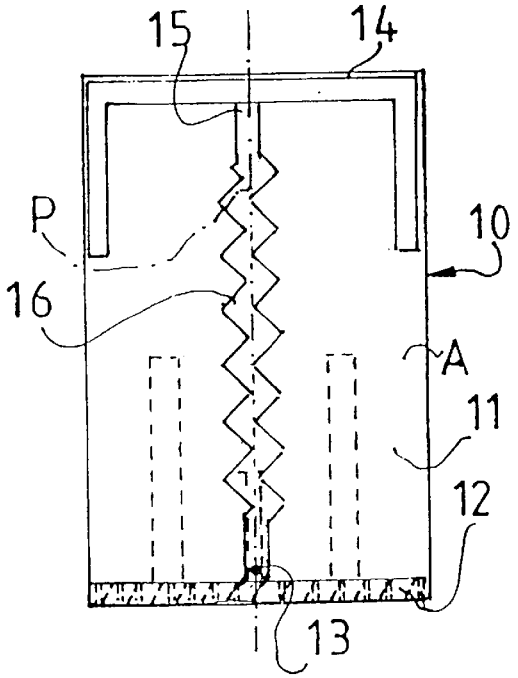
FIG. 1 is a front elevation.

FIG. 1 shows an antenna 10 on a circuit board 11 located relative to a ground plane 12 which serves to locate a feed point 13. FIG. 1 shows side A of the circuit board 11 on which is deposited as an etched copper conductor: top loading element 14 providing an attachment point 15; and driven element 16 extending from feed point 13 to attachment point 15.

A straight path P extends from feed point 13 to attachment point 15. The driven element 16 follows a meandering path about path P. The length defined by the central locus of the meandering driven element 16 is longer than that of the path P. As shown in the drawings the driven element 16 is for most of its length in the form of a zigzag. In an alternative version the meandering path can be in the form of curved elements rather than angular ones. In other versions the driven element can be made up of a mixture of shapes so long as its overall length is greater than that of path length P. The actual length of the driven element 16 is determined by the frequency at which the antenna is to be operated and any return loss requirements.

Figure 2:
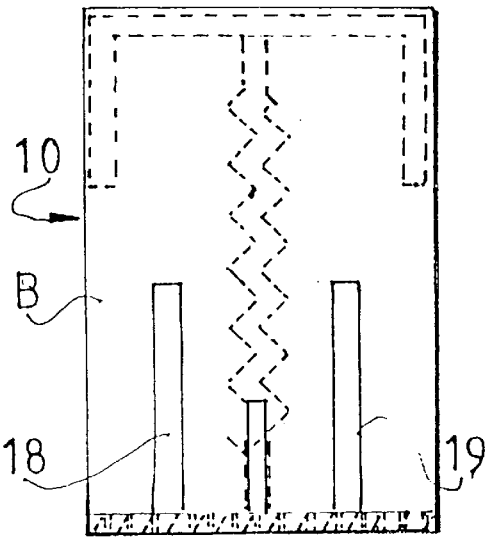
FIG. 2 is a rear elevation.

FIG. 2 shows side B on the opposite side of the circuit board 11 to side A described in connection with FIG. 1. Side B serves to locate a pair of copper parasite elements 18, 19 which are symmetrically disposed about path P and driven element 16. The parasite elements 18, 19 serve in dynamic combination with the driven element 16 to provide the required impedance match and broad band operating characteristics. In addition the parasite elements serve to limit radiation from the rear side of the driven element 16 which can be used to shield the nearest part of the body of a user of a mobile phone equipped with the antenna 10.

INDUSTRIAL APPLICABILITY

The configuration of the antenna of the present invention lends itself to provide an efficient unit of small overall size which is of particular benefit for a mobile phone. It can be made to fit an even smaller envelope by incorporating a passive component serving to provide a loading while maintaining transmitting/receiving efficiency. It has been found by trial that in terms of electrical performance the antenna of the present invention has a broader bandwidth and optimum impedance match than current designs. Although the proposed aerial is physically shorter than a ¼ wavelength whip it provides greater efficiency when compared with such a whip over a full frequency band width of 880–2000 MHz.

The antenna of the present invention provides full performance at all times unlike retractable antenna whose optimum performance requires the antenna to be in its extended rather than its retracted position.

The invention also envisages a mobile phone equipped with the proposed antenna. The antenna for this purpose can be embodied in a number of ways such as a printed circuit board as described in the exemplary embodiment, encapsulated between plastic skins or etched onto a plastic skin. Typically the antenna is incorporated in a hinged (flip top) lid to a body section of a mobile phone. Speaker and microphone are incorporated in the body section. The proposed parasite elements serve to provide shielding between the antenna and the side of the head of the user when pressed to the body section. Additional shielding may also be provided. The overall effect is to provide that energy that would otherwise be absorbed by the head of the user is re-directed giving an energy gain.

What is claimed is:

1. A communication antenna comprising:

a driven element extending between a feed point (13) and an attachment point (15) to a top loaded element;

the driven element (16) having a length and the length of the driven element (16) being greater than a straight path distance (P) between the feed point (13) and the attachment point (15); and the driven element (16) being configured to follow a meandering path between the feed point (13) and the attachment point (15);

wherein the communication antenna is equipped with at least one pair of parasitic elements (18, 19), and each one of the at least one pair of elements has at least one member and each of the at least one member of the at least one pair of elements are disposed on opposite sides of, and off-set from, the driven element (16) but parallel to the straight path (P) linking the feed point (13) to the attachment point (15); and the parasitic elements (18, 19) serve to provide impedance matching and increased bandwidth while also serve to at least partially shield against radiation from the antenna (10).

2. The communication antenna according to claim 1 wherein passive elements are incorporated with the parasitic elements (18, 19) to reduce an overall size of the antenna (10).

3. A mobile phone having an antenna (10), and the antenna (10) comprising:

a driven element extending between a feed point (13) and an attachment point (15) to a top loaded element;

the driven element (16) having a length and the length of the driven element (16) being greater than a straight path distance (P) between the feed point (13) and the attachment point (15); and parasitic elements (18, 19) being disposed relative to the driven element (16) to provide an increased bandwidth while also serving to at least partially shield against radiation from the antenna (10).

4. The mobile phone according to claim 3, wherein the antenna (10) is formed as one of a printed circuit board (11) and a deposit on a laminar member which has a structural function for at least part of the phone.

5. The mobile phone incorporating an antenna according to claim 3 wherein the driven element (16) is configured to follow a meandering path between the feed point (13) and the attachment point (15).

* * * * *